US010240489B2

(12) United States Patent
Maezako et al.

(10) Patent No.: US 10,240,489 B2
(45) Date of Patent: Mar. 26, 2019

(54) VARIABLE VALVE MECHANISM OF INTERNAL COMBUSTION ENGINE

(71) Applicant: OTICS CORPORATION, Nishio-shi (JP)

(72) Inventors: Takayuki Maezako, Nishio (JP); Akira Sugiura, Nishio (JP)

(73) Assignee: OTICS CORPORATION, Nishio-Shi, Aichi-Ken (JP)

( * ) Notice: Subject to any disclaimer, the term of this patent is extended or adjusted under 35 U.S.C. 154(b) by 78 days.

(21) Appl. No.: 15/363,866

(22) Filed: Nov. 29, 2016

(65) Prior Publication Data

US 2017/0218794 A1 Aug. 3, 2017

(30) Foreign Application Priority Data

Jan. 28, 2016 (JP) ..... 2016-013954

(51) Int. Cl.

| | |
|---|---|
| ***F01L 1/34*** | (2006.01) |
| ***F01L 1/18*** | (2006.01) |
| ***F01L 1/047*** | (2006.01) |
| ***F01L 13/00*** | (2006.01) |

(52) U.S. Cl.

CPC ..... *F01L 1/18* (2013.01); *F01L 1/047* (2013.01); *F01L 1/185* (2013.01); *F01L 1/34* (2013.01); *F01L 13/0005* (2013.01); *F01L 2001/186* (2013.01)

(58) Field of Classification Search

CPC ..... F01L 1/18; F01L 1/34; F01L 2001/186; F01D 25/246; F01D 5/02; F01D 9/041; F04D 29/321; F04D 29/522; F02D 29/542; F02C 3/04

See application file for complete search history.

(56) References Cited

U.S. PATENT DOCUMENTS

| | | | |
|---|---|---|---|
| 5,529,033 | A | 6/1996 | Hampton |
| 2004/0237919 | A1 | 12/2004 | Haas et al. |
| 2014/0150745 | A1 | 6/2014 | Church |

FOREIGN PATENT DOCUMENTS

| | | | |
|---|---|---|---|
| DE | 10 2004 039 503 | A1 | 3/2006 |
| JP | H 10-148112 | A | 6/1998 |
| JP | 2009-047111 | A | 3/2009 |
| JP | 2009-091969 | A | 4/2009 |

OTHER PUBLICATIONS

Extended European Search Report dated Mar. 2, 2017.

*Primary Examiner* — Zelalem Eshete
(74) *Attorney, Agent, or Firm* — McGinn I.P. Law Group, PLLC.

(57) ABSTRACT

A variable valve mechanism of an internal combustion engine includes a camshaft having a general shaft part and a cam part arranged next to each other in an axial direction, an input arm that swings when pressed by the cam part, an output arm that is swingably mounted and that drives a valve when swinging, and a switch device that switches the variable valve mechanism between a coupled state where the input arm and the output arm are coupled to swing together and an uncoupled state. The output arm has a great height so that clearance between the output arm and the general shaft part is 3 mm or less when the variable valve mechanism is in the coupled state and the valve is closed. If the output arm bounces in the uncoupled state, the output arm comes into contact with the general shaft part through the clearance.

14 Claims, 9 Drawing Sheets

COMPARATIVE EXAMPLE

COMPARATIVE EXAMPLE

COMPARATIVE EXAMPLE

VARIABLE VALVE MECHANISM OF INTERNAL COMBUSTION ENGINE

TECHNICAL FIELD

The present invention relates to variable valve mechanisms that drive valves of an internal combustion engine and change the drive state of the valves according to the operating condition of the internal combustion engine.

BACKGROUND ART

A variable valve mechanism 90 of a conventional example (Patent Document 1) shown in FIGS. 6A to 8C includes a camshaft 91, an input arm 92, and an output arm 93. The camshaft 91 has a driving cam 91*a* mounted thereon so as to project therefrom. The input arm 92 swings when driven by the driving cam 91*a*. The output arm 93 is swingably mounted next to the input arm 92 and drives a valve 7 when swinging. As shown in FIGS. 6A and 6B, the variable valve mechanism 90 is switched to a drive mode (coupled state), or a mode in which the output arm 93 drives the valve 7, by coupling the input arm 92 and the output arm 93 via a switch pin 94 so that the input arm 92 and the output arm 93 swing together. As shown in FIGS. 7A and 7B, the variable valve mechanism 90 is switched to a non-drive or no-lift mode (uncoupled state), or a mode where driving of the valve 7 is stopped, by uncoupling the input arm 92 from the output arm 93.

As shown in FIG. 8C etc., the camshaft 91 further has a no-lift cam 91*b* (round cam) mounted thereon at a position corresponding to the output arm 93 so as to project from the camshaft 91. The size of the no-lift cam 91*b* corresponds to the base circle of the driving cam 91*a*. In addition to Patent Document 1, Patent Documents 2, 3, etc. describe a camshaft having projections such as a no-lift cam (round cam) or a lobe.

CITATION LIST

Patent Document

[Patent Document 1] Japanese Patent Application Publication No. H10-148112

[Patent Document 2] Japanese Patent Application Publication No. 2009-091969

[Patent Document 3] United States Patent Application Publication No. 2014/0150745

SUMMARY OF INVENTION

Technical Problem

Providing the camshaft 91 with projections such as the no-lift cam 91*b* or the lobe increases the manufacturing cost of the camshaft 91 and also increases the mass of the camshaft 91. On the other hand, eliminating the no-lift cam 91*b* from the camshaft 91 of the conventional example as in a comparative example (variable valve mechanism 90') shown in FIGS. 9A to 9C causes the following problem.

In both of the conventional and comparative examples, if the variable valve mechanism 90 (90') is not switched from the drive mode (coupled state) to the non-drive or no-lift mode (uncoupled state) at the right timing, uncoupling of the output arm 93 from the input arm 92 is not completed during a base circle phase (while the valve 7 is closed). In this case, for example, an end of the switch pin 94 is caught by the input arm 92 (the valve 7 is lifted wrongly), and uncoupling of the output arm 93 from the input arm 92 is completed during a nose phase (while the valve 7 is lifted) as shown in FIG. 8A (conventional example) and FIG. 9A (comparative example). Accordingly, as shown in FIG. 8B (conventional example) and FIG. 9B (comparative example), the output arm 93 uncoupled from the input arm 92 bounces due to the elastic force of a valve spring 8. In addition, the output arm 93 may also bounce due to vibrations of an internal combustion engine, vibrations that are caused while a vehicle is traveling, etc.

In the conventional example, if the output arm 93 bounces as described above, further bouncing of the output arm 93 is prevented as the output arm 93 comes into contact with the no-lift cam 91*b* as shown in FIG. 8B. Bouncing of the output arm 93 is thus restrained.

In the comparative example (variable valve mechanism 90') that does not have the no-lift cam 91*b*, the output arm 93 bounces greatly within a range up to the position where the output arm 93 contacts a general shaft part of the camshaft 91 as shown in FIG. 9B. The output arm 93 is therefore unstable.

It is an object of the present invention to solve the problems of the conventional and comparative examples, namely to restrain bouncing of an output arm without providing a camshaft with projections such as a no-lift cam or a lobe which come into contact with the output arm.

Solution to Problem

In order to achieve the above object, a variable valve mechanism of the present invention is configured as follows. The variable valve mechanism includes a camshaft having a general shaft part and a cam part arranged next to each other in an axial direction, an input arm that swings when pressed by the cam part, an output arm that is swingably mounted and that drives a valve when swinging, and a switch device that switches the variable valve mechanism between a coupled state where the input arm and the output arm are coupled to swing together and an uncoupled state where the input arm and the output arm are uncoupled from each other.

The variable valve mechanism of the present invention has the following characteristics. The output arm has a great height so that clearance between the output arm and the general shaft part is 3 mm or less when the variable valve mechanism is in the coupled state and the valve is closed. If the output arm bounces in the uncoupled state, the output arm comes into contact with the general shaft part through the clearance.

Advantageous Effects of Invention

According to the present invention, when the output arm bounces, further bouncing of the output arm is prevented as the output arm comes into contact with the general shaft part of the camshaft. This eliminates the need to provide the camshaft with projections such as a no-lift cam (round cam) or a lobe which come into contact with the output arm. The manufacturing cost of the camshaft is thus reduced, and the mass of the camshaft is also reduced.

DESCRIPTION OF EMBODIMENTS

Figures 1A, 1B:
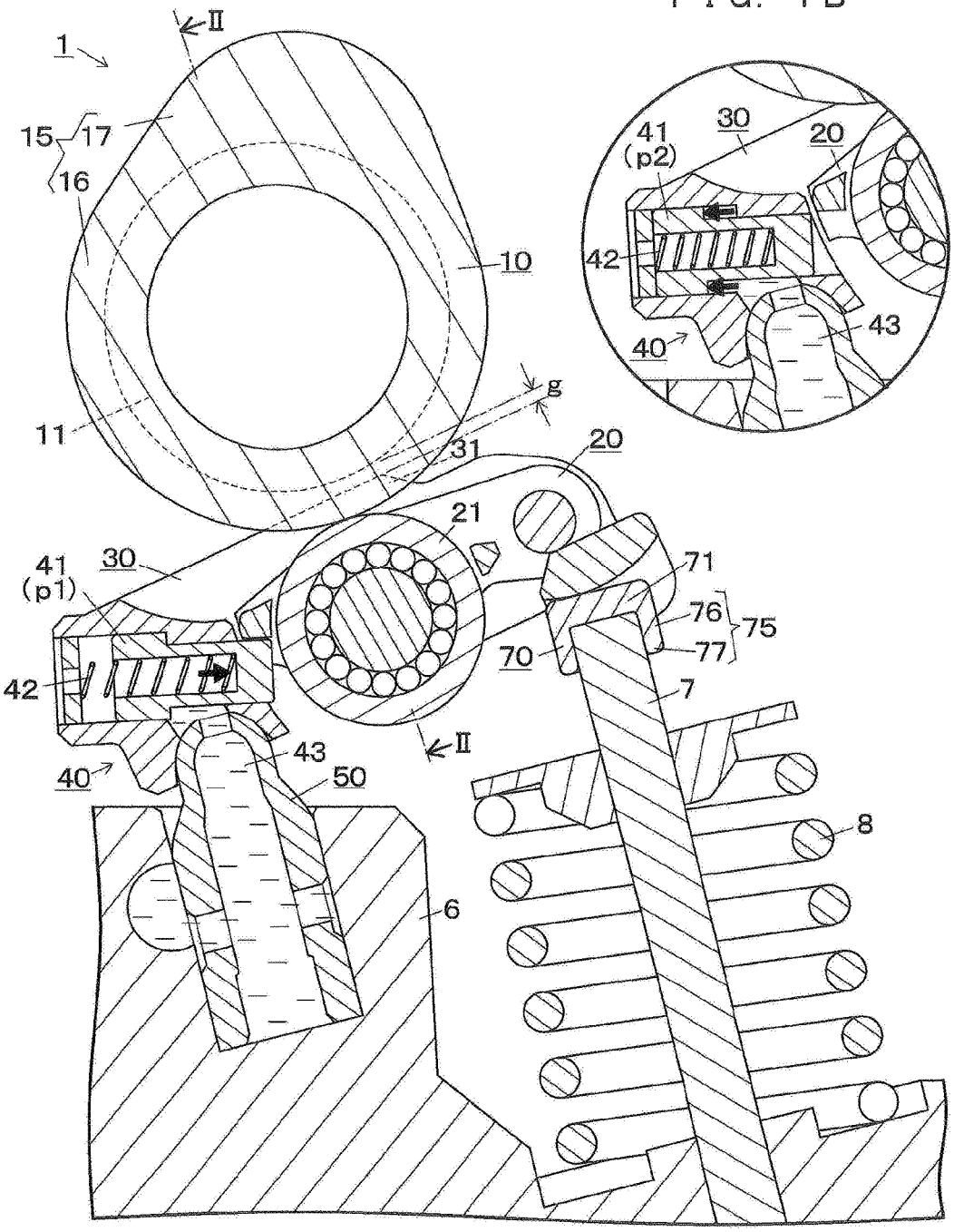
FIG. 1A is a side section (taken along line Ia-Ia in FIG. 2) of a variable valve mechanism of a first embodiment in a coupled state.
FIG. 1B is a side section of the variable valve mechanism of the first embodiment in an uncoupled state.

The reason why the clearance is 3 mm or less is as follows. A valve cap having a bottomed cylindrical shape and formed by a circular plate part and a cylinder part projecting from an outer edge of the circular plate part by 3 mm or more is often attached to a stem end of the valve. Providing the clearance of 3 mm or less can also sufficiently prevent the valve cap from coming off.

The clearance is not particularly limited as long as it is 3 mm or less. For improved stability of the output arm, the clearance is more preferably 1.5 mm or less, even more preferably 0.7 mm or less, and most preferably 0.3 mm or less.

Specific forms of the output arm include, but not limited to, the following forms.

(1) The output arm has the great height as a longitudinal intermediate portion of its outer wall is raised toward the general shaft part as viewed from a side.

(2) The output arm has the great height as it has a projection projecting toward the general shaft part.

First Embodiment

An embodiment of the present invention will be described. The present invention is not limited to the embodiment, and the configuration and shape of each part may be modified as desired without departing from the spirit and scope of the invention.

A variable valve mechanism 1 of a first embodiment shown in FIGS. 1A to 5B is a mechanism that periodically presses a valve 7 having a valve spring 8 attached thereto to drive the valve 7. The valve 7 has a valve cap 70 attached to its stem end. The valve cap 70 is a member having a bottomed cylindrical shape and is formed by a circular plate part 71 and a cylinder part 75 projecting from the outer edge of the circular plate part 71 by about 3.6 mm. Specifically, the cylinder part 75 has at its tip end a curved portion 77 having a curved surface. The cylinder part 75 other than the curved portion 77 is a straight portion 76. The straight portion 76 projects from the circular plate part 71 by about 3 mm, and the curved portion 77 projects from the straight portion 76 by about 0.6 mm.

The variable valve mechanism 1 includes a camshaft 10, an input arm 20, an output arm 30, and a switch device 40.

The camshaft 10 makes one full rotation for every two full rotations of an internal combustion engine. The camshaft 10 is a common shaft for a plurality of the variable valve mechanisms 1 and, as shown in FIG. 2, includes general shaft parts 11 and cam parts 15 which are arranged alternately in the axial direction. The general shaft part 11 is a cylindrical part and does not have projections such as a no-lift cam (round cam) or a lobe which come into contact with the output arm 30. The cam part 15 is a part that contacts the input arm 20, and as shown in FIGS. 1A, 1B etc., is formed by a base circle 16 having a circular section and a nose 17 protruding from the base circle 16.

Figure 2:
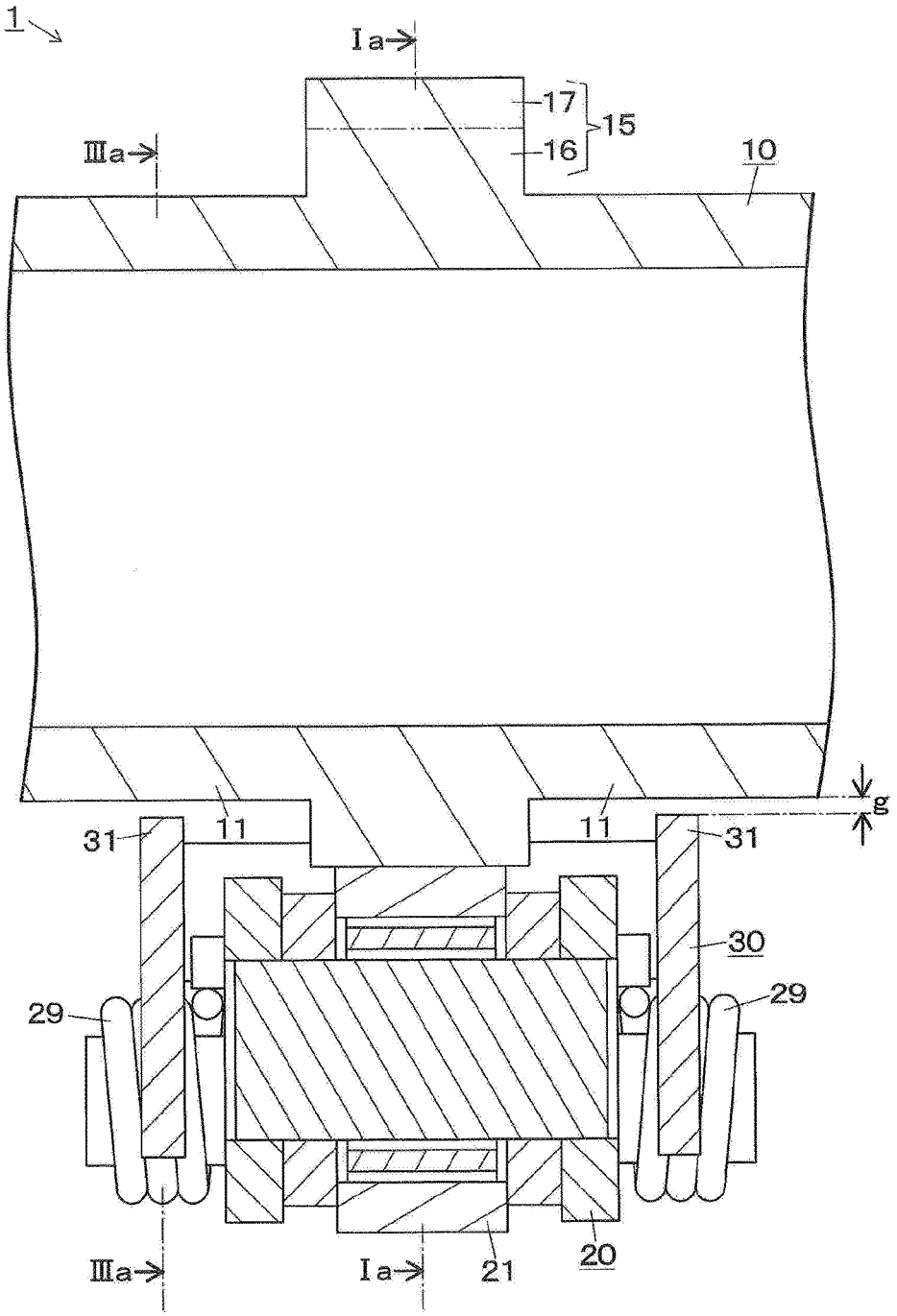
FIG. 2 is a front section (taken along line II-II in FIG. 1A) of the variable valve mechanism of the first embodiment.

As shown in FIGS. 1A, 1B, etc., the input arm 20 has its tip end pivotally coupled to the tip end of the output arm 30. The input arm 20 has a roller 21 rotatably mounted at its rear end. As shown in FIGS. 3A to 4B, the input arm 20 swings when the roller 21 is pressed by the cam part 15.

Figure 3B:
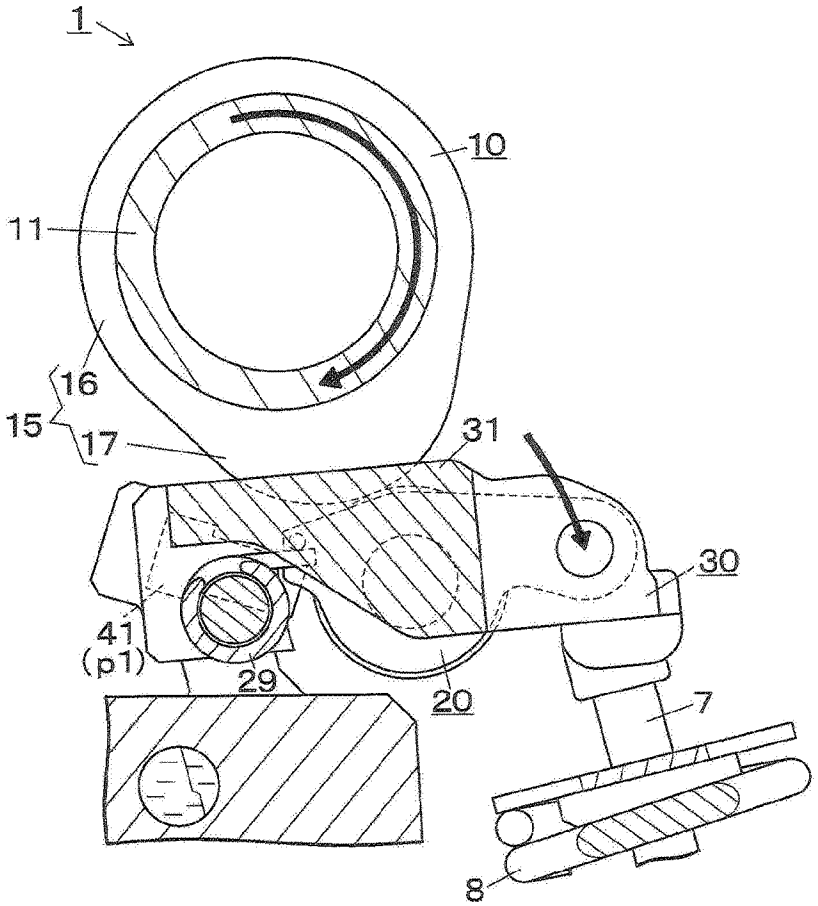
FIG. 3B is a side section showing a nose phase of the variable valve mechanism of the first embodiment in the coupled state.
Figure 3A:
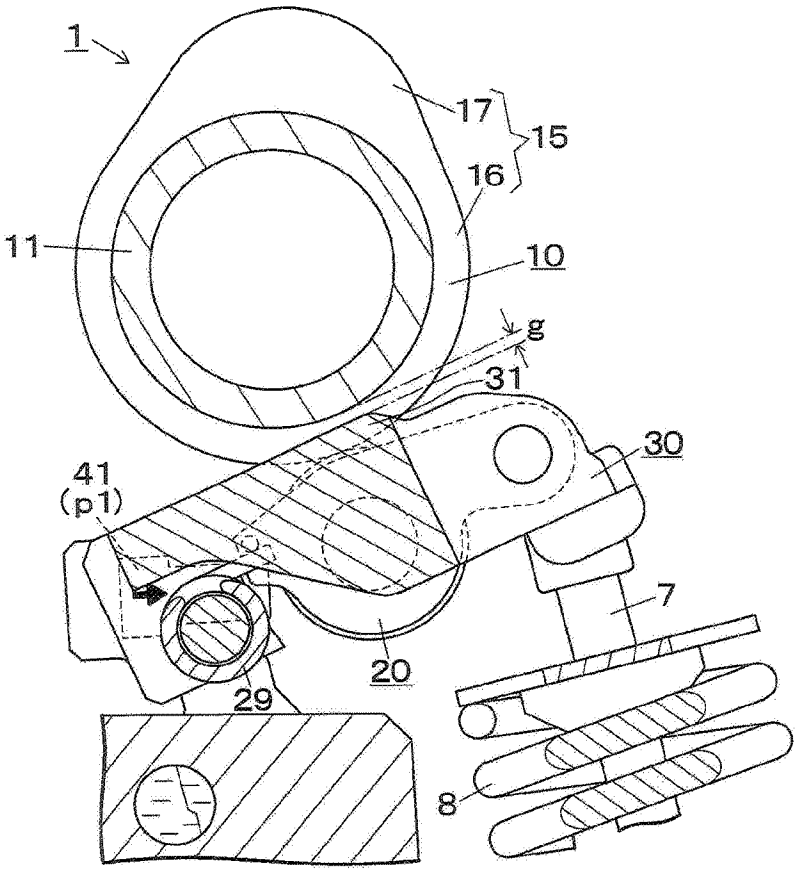
FIG. 3A is a side section (taken along line IIIa-IIIa in FIG. 2) showing a base circle phase of the variable valve mechanism of the first embodiment in the coupled state.
Figure 4B:
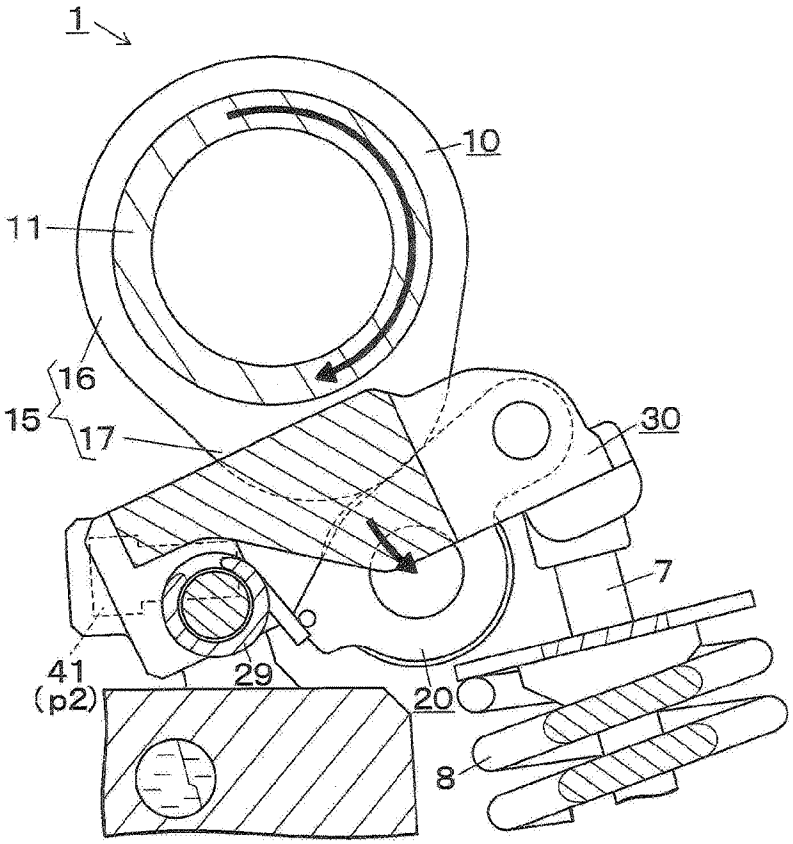
FIG. 4B is a side section showing a nose phase of the variable valve mechanism of the first embodiment in the uncoupled state.
Figure 4A:
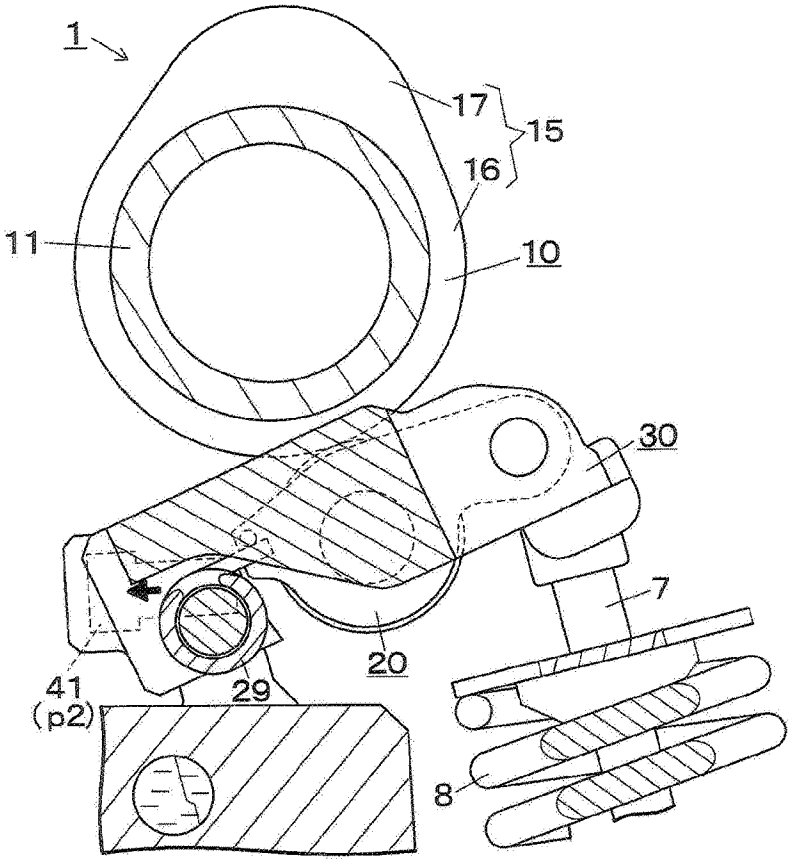
FIG. 4A is a side section showing a base circle phase of the variable valve mechanism of the first embodiment in the uncoupled state.

As shown in FIGS. 1A, 1B, etc., the output arm 30 is swingably supported at its rear end by a pivot 50, and the tip end of the output arm 30 is in contact with the stem end of the valve 7. In a coupled state where the output arm 30 is coupled to the input arm 20 as shown in FIGS. 3A and 3B, the output arm 30 swings with the input arm 20 to drive the valve 7. In an uncoupled state where the output arm 30 is uncoupled from the input arm 20 as shown in FIGS. 4A and 4B, the output arm 30 does not swing and the valve 7 is not driven. The output arm 30 has a lost motion spring 29 attached thereto. The lost motion spring 29 biases the input arm 20 toward the cam part 15.

As shown in FIGS. 1A, 1B, etc., the output arm 30 has a great height as longitudinal intermediate portions 31 of its outer walls are raised toward the general shaft parts 11 as viewed from the side. The output arm 30 is thus formed so that clearance g between the output arm 30 and the general shaft part 11 is as small as possible during a base circle phase (while the valve 7 is closed) of the variable valve mechanism 1 in the coupled state. In the present embodiment, the clearance g is about 0.1 to 2 mm.

The switch device 40 includes a switch pin 41, a spring 42, and an oil pressure path 43.

As shown in FIGS. 1A, 1B, etc., the switch pin 41 is attached to the rear part of the output arm 30 and can be displaced between a front coupled position p1 where the output arm 30 is coupled to the input arm 20 and a rear uncoupled position p2 where the output arm 30 is uncoupled from the input arm 20. Specifically, as shown in FIG. 1A, the front coupled position p1 is a position where the front part of the switch pin 41 projects from the rear part of the output arm 30 to a position below the rear end of the input arm 20. As shown in FIG. 1B, the rear uncoupled position p2 is a position where the switch pin 41 is withdrawn in the rear part of the output arm 30.

The spring 42 is a device that displaces the switch pin 41 from the rear uncoupled position p2 to the front coupled position p1. The spring 42 is disposed in the rear part of the output arm 30 and biases the switch pin 41 forward.

The oil pressure path 43 is a path through which an oil pressure is supplied to displace the switch pin 41 from the front coupled position p1 to the rear uncoupled position p2. The oil pressure path 43 extends from the inside of a cylinder head 6 to the inside of the rear part of the output arm 30 through a pivot 50. The oil pressure path 43 applies an oil pressure rearward to the switch pin 41.

Specifically, as shown in FIG. 1A, the switch pin 41 is placed at the front coupled position p1 based on the elastic force of the spring 42 when the oil pressure in the oil pressure path 43 is set to a normal pressure. As shown in FIG. 1B, the switch pin 41 is placed at the rear uncoupled position p2 based on the oil pressure in the oil pressure path 43 when the oil pressure in the oil pressure path 43 is set to a switch pressure higher than the normal pressure.

Figure 5B:
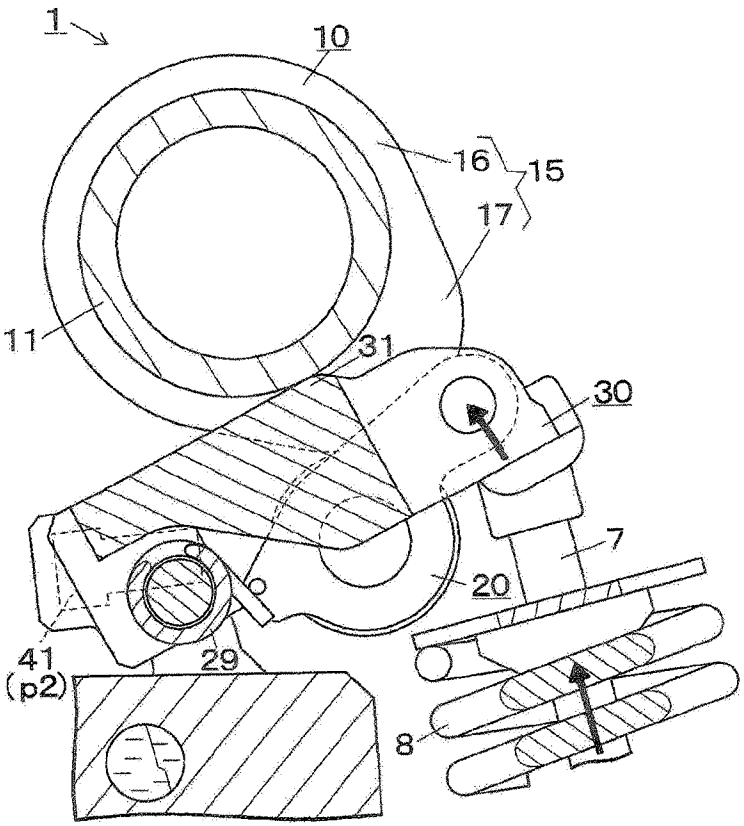
FIG. 5B is a side section of the variable valve mechanism of the first embodiment with an output arm bouncing after the completion of the switching.
Figure 5A:
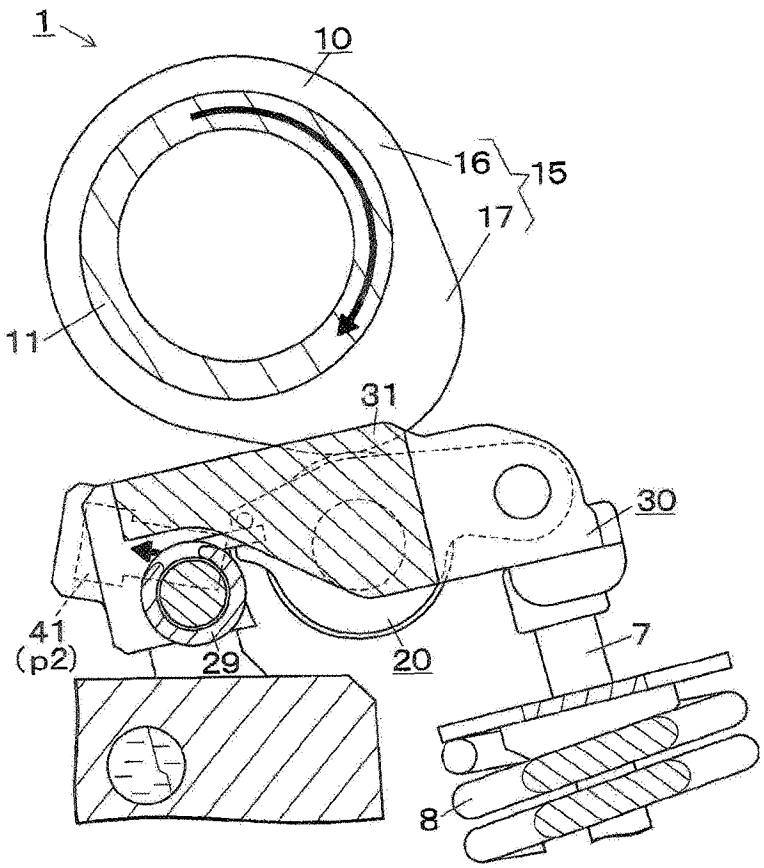
FIG. 5A is a side section showing the state where switching of the variable valve mechanism of the first embodiment from the coupled state to the uncoupled state has been completed during a nose phase.
Figure 6B:
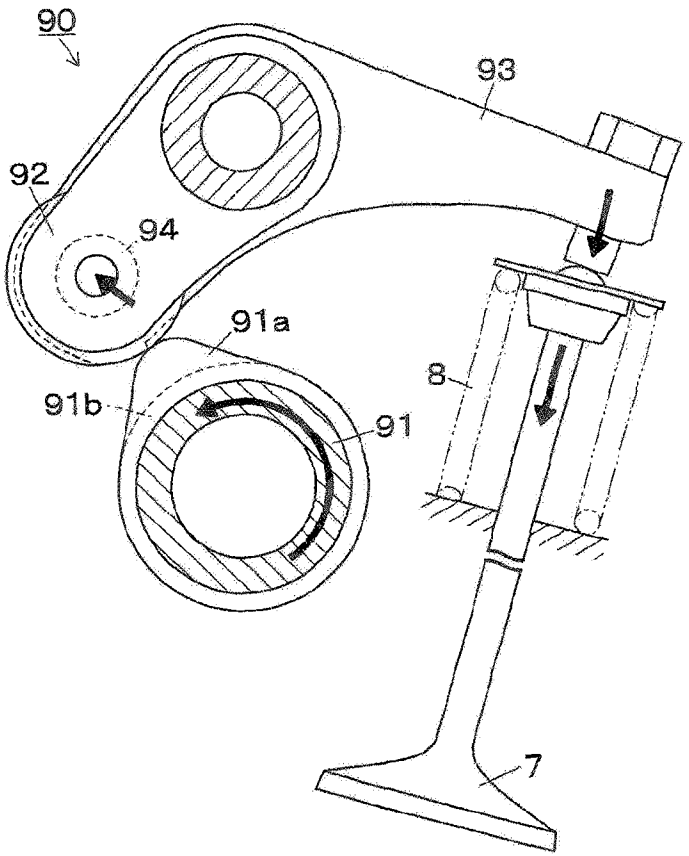
FIG. 6B PRIOR ART
FIG. 6B is a side section showing a nose phase of the variable valve mechanism of the conventional example in the coupled state.
Figure 6A:
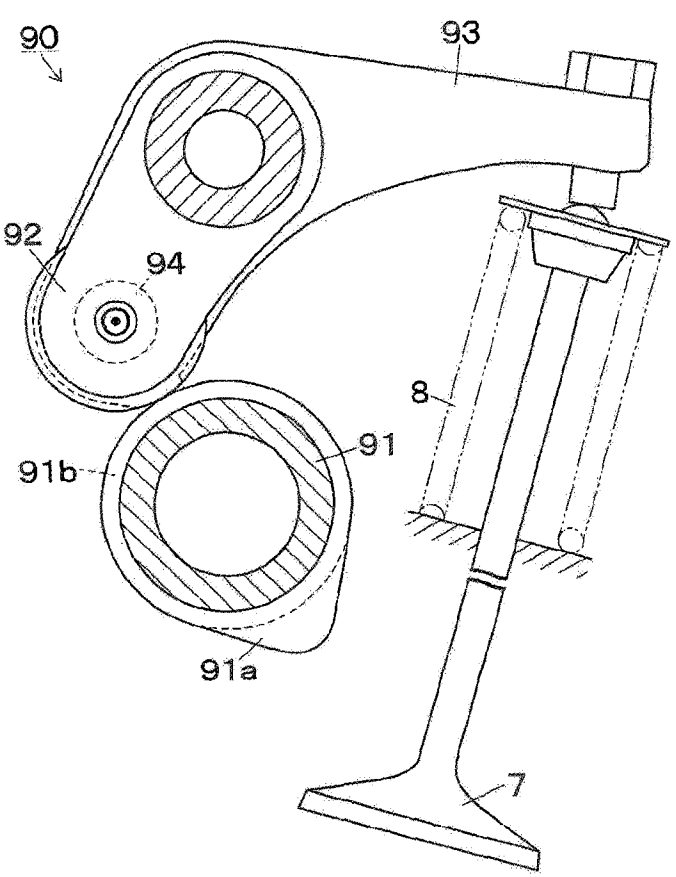
FIG. 6A PRIOR ART
FIG. 6A is a side section showing a base circle phase of a variable valve mechanism of a conventional example in a coupled state.
Figure 7B:
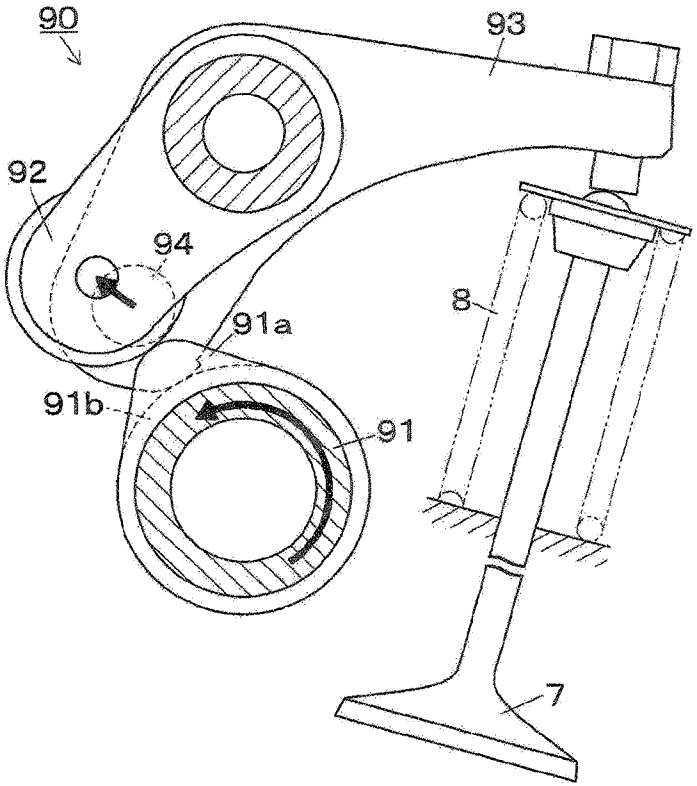
FIG. 7B PRIOR ART
FIG. 7B is a side section showing a nose phase of the variable valve mechanism of the conventional example in the uncoupled state.
Figure 7A:
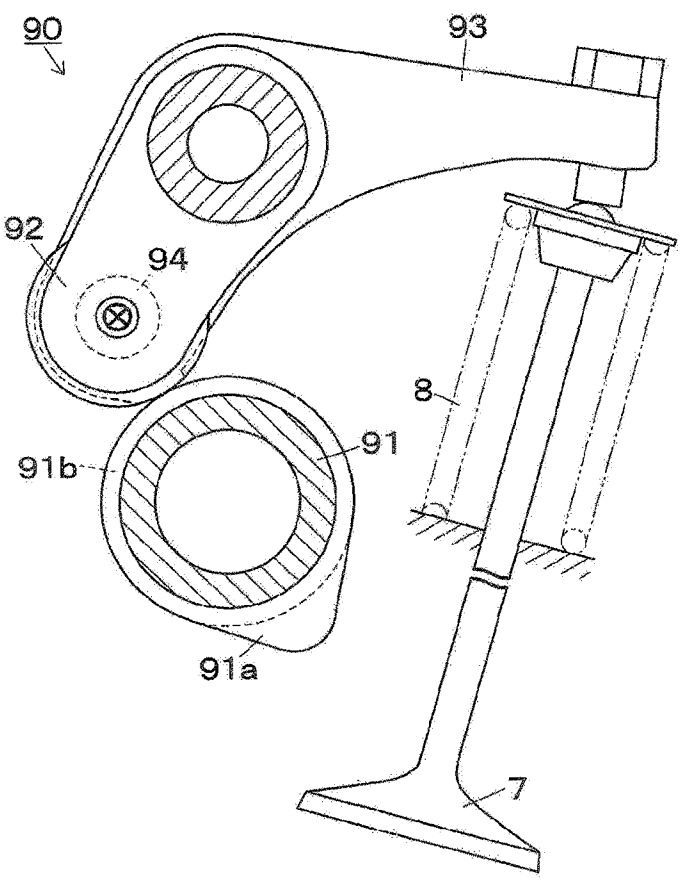
FIG. 7A PRIOR ART
FIG. 7A is a side section showing a base circle phase of the variable valve mechanism of the conventional example in an uncoupled state.
Figure 8B:
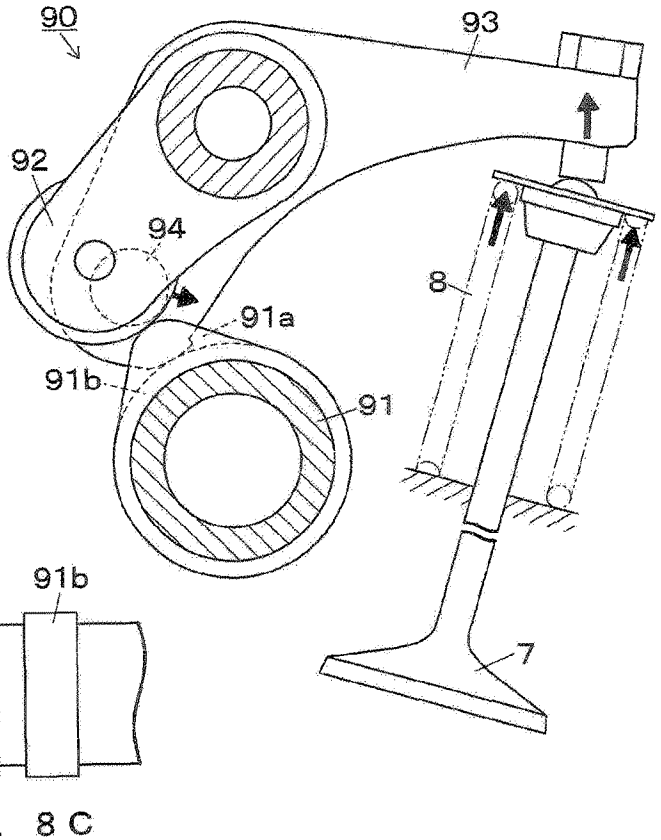
FIG. 8B PRIOR ART
FIG. 8B is a side section of the variable valve mechanism of the conventional example with an output arm bouncing after the completion of the switching.
Figure 8C:
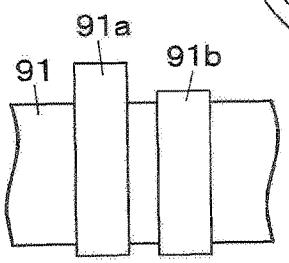
FIG. 8C PRIOR ART
FIG. 8C is a front view of a camshaft.
Figure 8A:
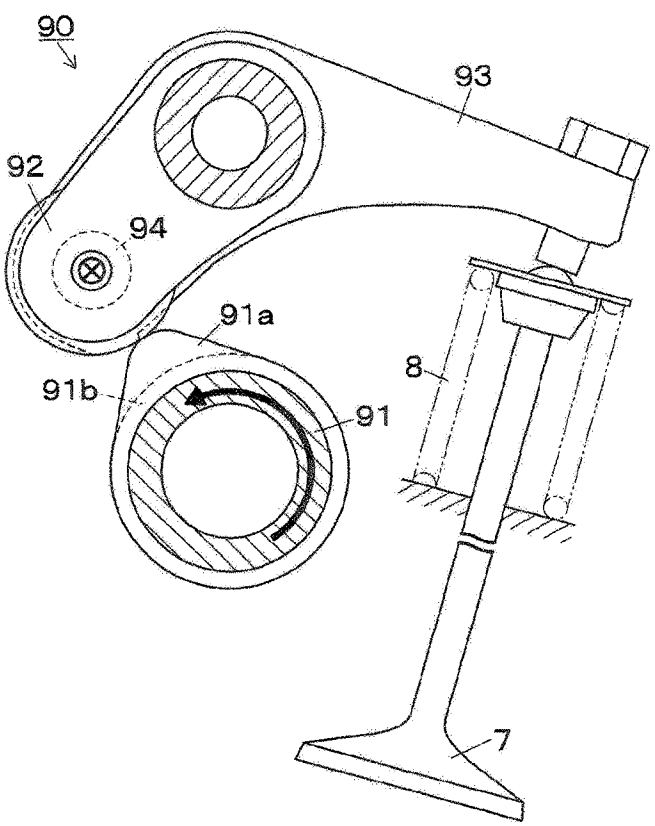
FIG. 8A PRIOR ART
FIG. 8A is a side section showing the state where switching of the variable valve mechanism of the conventional example from the coupled state to the uncoupled state has been completed during a nose phase.
Figure 9B:
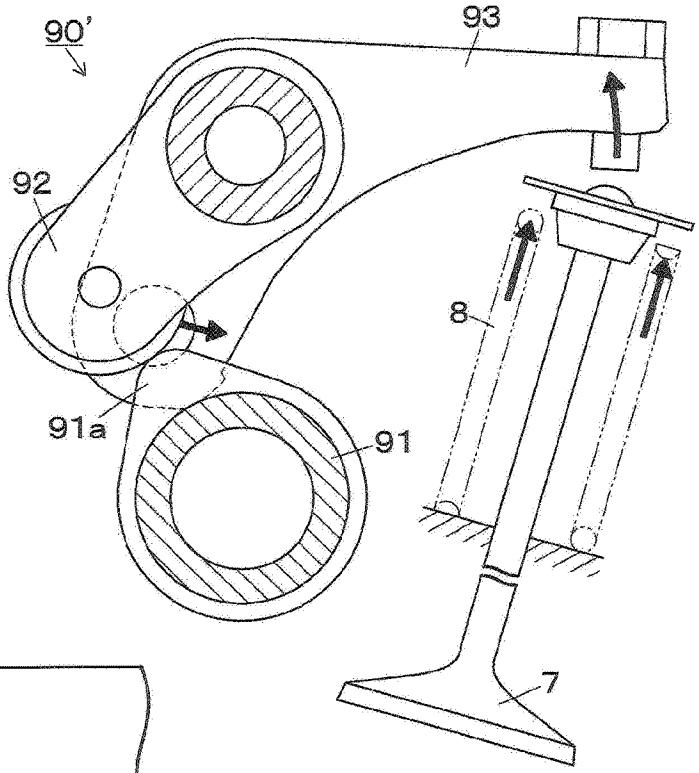
FIG. 9B is a side section of the variable valve mechanism of the comparative example with an output arm bouncing after the completion of the switching.
Figure 9C:
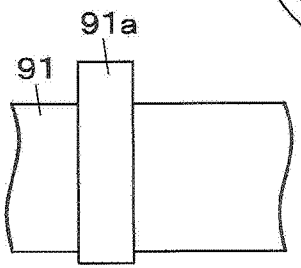
FIG. 9C is a front view of a camshaft.
Figure 9A:
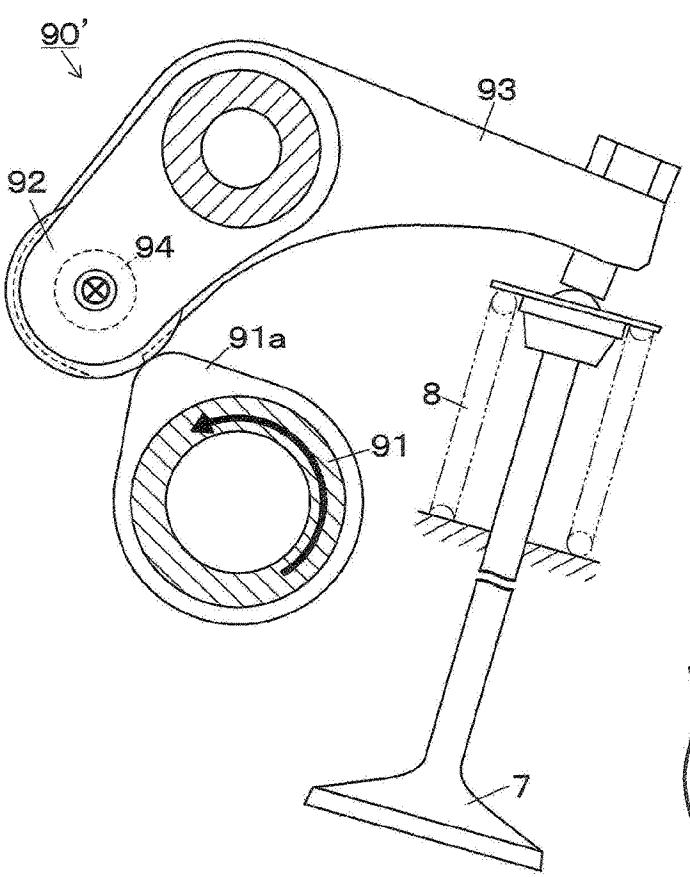
FIG. 9A is a side section showing the state where switching of a variable valve mechanism of a comparative example from a coupled state to an uncoupled state has been completed during a nose phase.

The first embodiment has the following effects. If the variable valve mechanism 1 is not switched from the coupled state (drive mode) to the uncoupled state (non-drive or no-lift mode) at the right timing, uncoupling of the output arm 30 from the input arm 20 is not completed during a base circle phase (while the valve 7 is closed). In this case, for example, an end of the switch pin 41 is caught by the input arm 20 (the valve 7 is lifted wrongly), and uncoupling of the output arm 30 from the input arm 20 is completed during a nose phase (while the valve 7 is lifted) as shown in FIG. 5A. Accordingly, as shown in FIG. 5B, the output arm 30 uncoupled from the input arm 20 bounces due to the elastic force of the valve spring 8. However, further bouncing of the output arm 30 is prevented as the longitudinal intermediate portions 31 of the output arm 30 come into contact with the general shaft parts 11 of the camshaft 10 through the clearance g. Bouncing of the output arm 30 is thus restrained.

In addition, the output arm 30 may bounce due to vibrations of the internal combustion engine, vibrations that are caused while a vehicle is traveling, etc. In this case as well, further bouncing of the output arm 30 is similarly prevented as the longitudinal intermediate portions 31 of the output arm 30 come into contact with the general shaft parts 11 of the camshaft 10. Bouncing of the output arm 30 is thus restrained.

As described above, further bouncing of the output arm 30 is prevented as the output arm 30 comes into contact with the general shaft parts 11 of the camshaft 10. This eliminates the need to provide the camshaft 10 with projections such as a no-lift cam (round cam) or a lobe which come into contact with the output arm 30. The manufacturing cost of the camshaft 10 is thus reduced, and the mass of the camshaft 10 is also reduced.

REFERENCE SIGNS LIST

1 Variable valve mechanism
7 Valve
10 Camshaft
11 General shaft part
15 Cam part
20 Input arm
30 Output arm
40 Switch device
g Clearance between output arm and general shaft part

The invention claimed is:

1. A variable valve mechanism of an internal combustion engine comprising:

a camshaft having a general shaft part and a cam part arranged next to each other in an axial direction;

an input arm that swings when pressed by the cam part;

an output arm that is swingably mounted and that drives a valve when swinging; and a switch device that switches the variable valve mechanism between a coupled state where the input arm and the output arm are coupled to swing together and an uncoupled state where the input arm and the output arm are uncoupled from each other, wherein the output arm has a greatest height so that a clearance between the output arm and the general shaft part is in a range of 0.1 mm to 0.3 mm when the variable valve mechanism is in the coupled state and the valve is closed, and if the output arm bounces in the uncoupled state, the output arm comes into contact with the general shaft part through the clearance.

2. The variable valve mechanism of the internal combustion engine according to claim 1, wherein the output arm includes a rear end that is swingably supported, a tip end that contacts a stem end of the valve, and an outer wall that extends between the rear end and the tip end, and the output arm has the greatest height as a longitudinal intermediate portion of the outer wall is raised toward the general shaft part as viewed from a side.

3. The variable valve mechanism of the internal combustion engine according to claim 1, wherein the output arm has the greatest height as it has a projection projecting toward the general shaft part.

4. The variable valve mechanism of the internal combustion engine according to claim 1, wherein the switch device includes a switch pin, the switch pin is attached to a rear part of the output arm and can be displaced between a front coupled position where the input arm and the output arm are coupled together and a rear uncoupled position where the input arm and the output arm are uncoupled from each other, the front coupled position comprises a position where a front part of the switch pin projects from the rear part of the output arm to a position below a rear end of the input arm, and the rear uncoupled position comprises a position where the switch pin is withdrawn in the rear part of the output arm.

5. The variable valve mechanism of the internal combustion engine according to claim 4, wherein the switch device includes a spring that displaces the switch pin from the rear uncoupled position to the front coupled position, and the spring is disposed in the rear part of the output arm and biases the switch pin forward.

6. The variable valve mechanism of the internal combustion engine according to claim 5, wherein the switch device includes an oil pressure path through which an oil pressure is supplied to displace the switch pin from the front coupled position to the rear uncoupled position, and the oil pressure path extends from inside of a cylinder head to inside of the rear part of the output arm through a pivot, and applies the oil pressure rearward to the switch pin.

7. The variable valve mechanism of the internal combustion engine according to claim 6, wherein the switch device places the switch pin at the front coupled position based on an elastic force of the spring when the oil pressure in the oil pressure path is set to a normal pressure, and places the switch pin at the rear uncoupled position based on the oil pressure when the oil pressure in the oil pressure path is set to a switch pressure higher than the normal pressure.

8. The variable valve mechanism of the internal combustion engine according to claim 1, wherein a tip end of the input arm is pivotally coupled to a tip end of the output arm.

9. The variable valve mechanism of the internal combustion engine according to claim 1, wherein, in the coupled state where the output arm is coupled to the input arm, the output arm swings with the input arm to drive the valve, and wherein, in the uncoupled state where the output arm is uncoupled from the input arm, the output arm does not swing and the valve is not driven.

10. The variable valve mechanism of the internal combustion engine according to claim 1, further comprising a lost motion spring attached to the output arm, wherein the lost motion spring biases the input arm toward the cam part.

11. The variable valve mechanism of the internal combustion engine according to claim 1, wherein the greatest height of the output arm is set at a position where longitudinal intermediate portions of outer walls of the output arm are raised toward the general shaft part as viewed from a side.

12. The variable valve mechanism of the internal combustion engine according to claim 1, wherein the switch device includes a switch pin, and the switch pin is attached to a rear part of the output arm and can be displaced between a front coupled position where the input arm and the output arm are coupled together and a rear uncoupled position where the input arm and the output arm are uncoupled from each other.

13. The variable valve mechanism of the internal combustion engine according to claim 1, wherein the switch device includes a switch pin and places the switch pin at a first coupled position based on an elastic force of a spring when an oil pressure in a oil pressure path is set to a first pressure, and places the switch pin at a rear uncoupled position based on the oil pressure when the oil pressure in the oil pressure path is set to a switch pressure higher than the first pressure.

14. The variable valve mechanism of the internal combustion engine according to claim 1, wherein the clearance between the output arm and the general shaft part is measured in a vertical direction.

* * * * *